US011365928B2

(12) United States Patent
Ellis et al.

(10) Patent No.: US 11,365,928 B2
(45) Date of Patent: Jun. 21, 2022

(54) COMPARTMENTED REFRIGERATION SYSTEM

(71) Applicants: Isaac Ellis, Lansing, IL (US); Brenda Ellis, Lansing, IL (US)

(72) Inventors: Isaac Ellis, Lansing, IL (US); Brenda Ellis, Lansing, IL (US)

( * ) Notice: Subject to any disclaimer, the term of this patent is extended or adjusted under 35 U.S.C. 154(b) by 0 days.

(21) Appl. No.: 17/005,641

(22) Filed: Aug. 28, 2020

(65) Prior Publication Data

US 2021/0095909 A1 Apr. 1, 2021

Related U.S. Application Data

(60) Provisional application No. 62/908,685, filed on Oct. 1, 2019.

(51) Int. Cl.

| | |
|---|---|
| ***F25D 13/04*** | (2006.01) |
| ***F25D 23/02*** | (2006.01) |
| ***F25D 23/04*** | (2006.01) |
| *F25D 23/06* | (2006.01) |
| *F25D 13/02* | (2006.01) |

(52) U.S. Cl.

CPC ..... *F25D 13/04* (2013.01); *F25D 23/028* (2013.01); *F25D 23/04* (2013.01); *F25D 13/02* (2013.01); *F25D 23/02* (2013.01); *F25D 23/025* (2013.01); *F25D 23/069* (2013.01)

(58) Field of Classification Search

CPC ..... F25D 13/02; F25D 13/04; F25D 23/02; F25D 23/04; F25D 23/025; F25D 23/028; F25D 23/069; F25D 29/005

See application file for complete search history.

(56) References Cited

U.S. PATENT DOCUMENTS

| | | | | | |
|---|---|---|---|---|---|
| 2,421,439 | A * | 6/1947 | Smith | F25D 13/02 | 62/382 |
| 2,437,215 | A * | 3/1948 | Wheeler | F25D 13/02 | 62/405 |
| 4,009,590 | A * | 3/1977 | Webb | F25D 17/045 | 62/180 |
| 5,910,163 | A * | 6/1999 | Schlamp | F25D 23/025 | 62/186 |
| 6,101,819 | A * | 8/2000 | Onaka | F25D 29/005 | 62/125 |
| 10,467,836 | B1 * | 11/2019 | Kirchhausen | G07C 9/00904 | |

(Continued)

*Primary Examiner* — Joseph F Trpisovsky

(74) *Attorney, Agent, or Firm* — Boudwin Intellectual Property; Daniel Boudwin

(57) ABSTRACT

A compartmented refrigeration system is provided. The compartmented refrigeration system has a housing with an access door. The housing further includes a refrigeration system that can adjustably reduce the temperature in the housing's interior volume. The refrigeration system includes a compressor, a plurality of condenser coils, at least one expansion valve, a plurality of evaporator coils, and a refrigerant that can travel through the various components. A refrigeration controller is disposed in the housing interior volume to enable a user to adjust the temperature therein. A plurality of compartments is disposed in the housing interior volume. Each of the compartments are in thermal communication with the refrigeration system and further comprise a compartment access door. The compartment access door further includes a lock that a user can use to secure the individual compartment.

6 Claims, 4 Drawing Sheets

(56) References Cited

U.S. PATENT DOCUMENTS

| | | | | |
|---|---|---|---|---|
| 2008/0130203 | A1* | 6/2008 | Doberstein | F25D 29/005 361/601 |
| 2010/0154452 | A1* | 6/2010 | McCann | A23L 13/70 62/247 |
| 2012/0144856 | A1* | 6/2012 | Sherlock | F25D 17/062 62/419 |
| 2012/0209763 | A1* | 8/2012 | Zabbatino | G06Q 30/0645 705/39 |
| 2013/0111936 | A1* | 5/2013 | Olson | F25D 23/028 62/127 |
| 2019/0362579 | A1* | 11/2019 | Phillips | F25D 29/006 |
| 2020/0093309 | A1* | 3/2020 | Raphael | A47B 67/02 |
| 2020/0116414 | A1* | 4/2020 | Dade | F25B 29/003 |

* cited by examiner

COMPARTMENTED REFRIGERATION SYSTEM

CROSS REFERENCE TO RELATED APPLICATIONS

This application claims the benefit of U.S. Provisional Application No. 62/908,685 filed on Oct. 1, 2019. The above identified patent application is herein incorporated by reference in its entirety to provide continuity of disclosure.

BACKGROUND OF THE INVENTION

The present invention relates to refrigerators. More particularly, the present invention provides for a compartmented refrigeration system that can be used by multiple people at the same time, wherein each compartment can be locked and secured such that unauthorized tampering with the contents of the compartment is prevented.

Many people bring food, drink, and/or medication with them to communal spaces such as office buildings, schools, and the like. On occasion, such a space may have a communal refrigerator for use in storing temperature sensitive items such as their food, drink, or medications. However, such communal refrigerators are commonly filled with forgotten food, or can be ransacked by an unscrupulous individual looking for something to eat. Storing items in the communal refrigerator, unsecured, can be a recipe for disaster and can produce stressful situations for the people storing their items inside. Tampering with an individual's food is common and can be difficult to prevent. Additionally, various items require different temperatures to be safely stored. Communal refrigerators are not capable of adjusting and fine-tuning temperatures for each individual item stored therein.

Devices have been disclosed in the known art that relate to refrigerators. These include devices that have been patented and disclosed in patent application publications. However, the devices in the known art have several drawbacks. Some refrigerators are incapable of producing temperatures low enough to store frozen items; some refrigerators are too small to accommodate large numbers of people and personal items; and some refrigerators are unable to secure a subset of items stored inside and prevent unauthorized access or tampering. Additionally, typical refrigerators are limited to a single temperature in the storage compartment and cannot accommodate a variety of temperatures to adequately and safely store a variety of items.

The present invention substantially diverges in design elements from the known art and consequently it is clear that there is a need in the art for an improvement to existing refrigerator devices. In this regard the present invention substantially fulfills these needs.

SUMMARY OF THE INVENTION

In view of the foregoing disadvantages inherent in the known types of refrigerators now present in the prior art, the present invention provides a compartmented refrigeration system wherein the same can be utilized by multiple people at the same time, wherein each compartment can be locked and secured such that unauthorized tampering with the contents of the compartment is prevented. The present compartmented refrigeration system comprises a housing with an access door. The housing further includes a refrigeration system that can adjustably reduce the temperature in the housing's interior volume. The refrigeration system includes a compressor, a plurality of condenser coils, at least one expansion valve, a plurality of evaporator coils, and a refrigerant that can travel through the various components. A refrigeration controller is disposed in the housing interior volume to enable a user to adjust the temperature therein. A plurality of compartments is disposed in the housing interior volume. Each of the compartments are in thermal communication with the refrigeration system and further comprise a compartment access door. The compartment access door further includes a lock that a user can use to secure the individual compartment.

In an alternate embodiment, each of the compartments of the compartmented refrigeration system further includes a compartment refrigeration system that can be utilized to further customize and adjust the temperature in each individual compartment.

In another embodiment, the housing includes an insulating material and each of the compartments of the compartmented refrigeration system further includes a compartment refrigeration system, such that the housing maintains a temperature, and each individual compartment can be customized as to the temperature therein.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
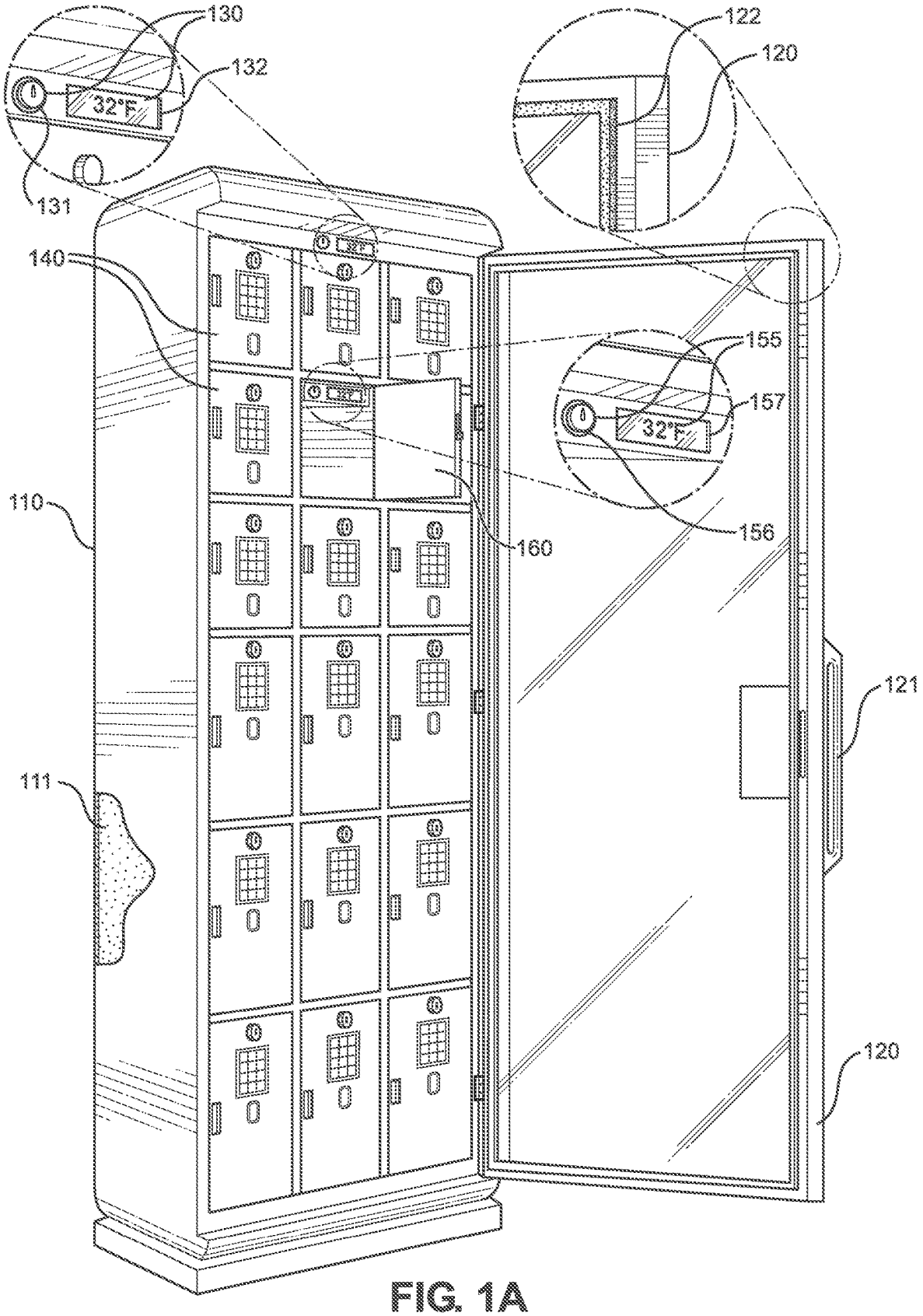
FIG. 1A shows a perspective view of an embodiment of the compartmented refrigeration system.

Reference is made herein to the attached drawings. Like reference numerals are used throughout the drawings to depict like or similar elements of the compartmented refrigeration system. For the purposes of presenting a brief and clear description of the present invention, a preferred embodiment will be discussed as used for the compartmented refrigeration system. The figures are intended for representative purposes only and should not be considered to be limiting in any respect.

Referring now to FIG. 1A, there is shown a perspective view of an embodiment of the compartmented refrigeration system. The compartmented refrigeration system comprises a housing 110 with an access door 120 defining a housing interior volume. The housing 110 can vary in size according to the needs of the user and is composed of durable materials such as stainless steel. In the shown embodiment, the housing 110 comprises a rectangular cross-section and the access door 120 is hingedly attached to a sidewall along a longitudinal length enabling the access door 120 to move between an open and a closed configuration. Further, in the shown embodiment, the access door 120 is transparent such that a user can look into the housing interior volume without opening the access door 120. In the shown embodiment, the access door 120 comprises a handle 121 that can be utilized to move the access door 120 between the open and closed configurations. In one embodiment, the housing 110 is configured to be free-standing and provides support and structure for the stand-alone compartmented refrigeration system.

In one embodiment, the housing 110 further comprises a housing insulation material 111. The housing insulation material 111 provides a thermal barrier that enables a temperature inside the housing 110 to be insulated from a temperature outside of the housing 110. In one embodiment, the access door 120 includes a door insulation material 122 that contacts the access door 120 when the access door 120 is in a closed configuration and creates a thermal seal such that heat is not lost through the joint between the access door 120 and the housing 110. In this manner, a temperature of the housing interior volume can be maintained when the access door 120 is in the closed configuration. One of ordinary skill in the art will understand how a thermal seal can be created between the door insulation material 122 and the access door 120 in the closed configuration.

Figure 2:
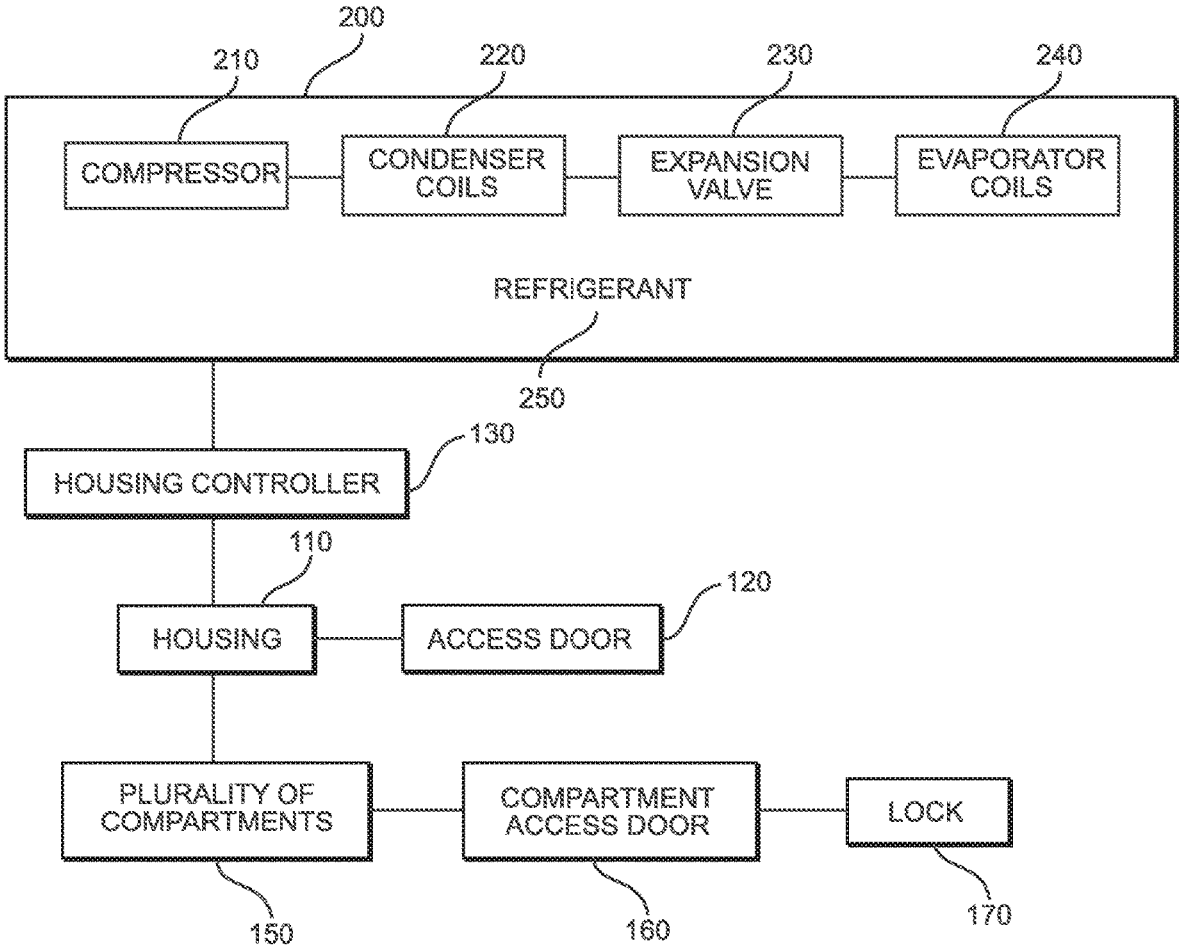
FIG. 2 shows a schematic of an embodiment of the compartmented refrigeration system, with a focus on representative components thereof.

The housing 110 further comprises a refrigeration system (as shown in FIG. 2, 200.) The refrigeration system is configured to utilize a refrigerant to transfer heat from the interior volume of the housing to a space external to the compartmented refrigeration system. One of ordinary skill in the art will understand how a refrigeration system, utilizing the refrigerant, as well as a compressor, condenser coils, expansion valves, and evaporator coil can be used to transfer heat outside the device, thereby reducing a temperature within the device. In various embodiments, a ventilation system, including fans, can be disposed without the housing 110 in order to further direct and channel air in various parts of the device, as required.

A refrigeration controller 130 is disposed in the housing interior volume which can be utilized to adjust the flow of the refrigerant, as well as control the ventilation system within the interior volume to control the temperature therein. In the shown embodiment, the refrigeration controller 130 is a manual controller 131 comprising a dial which can be rotated to set, adjust, and maintain the temperature. In an alternate embodiment, the refrigeration controller 130 is a digital controller 132 which can be utilized to set, adjust, and maintain a desired temperature.

A plurality of compartments 140 are disposed in the housing interior volume. The compartments 140 are each in thermal communication with the refrigeration system. In one embodiment, the refrigeration system is integrated into and through the walls of each of the compartments 140. In an alternate embodiment, the refrigeration system is in physical contact with the exterior surface of each of the compartments 140 and heat is transferred by conduction. In another embodiment, the refrigeration system cools the housing interior volume thereby lowering the temperature of each of the plurality of compartments 140 by convection.

Through the use of an integrated ventilation system, the temperature of each of the plurality of compartments 140 can be independently adjusted to a user's preference. One of ordinary skill in the art will understand how the use of vents and air flow can be utilized to independently control the temperature in each of the plurality of compartments 140. In various embodiments, each of the compartments 140 further comprise a compartment refrigeration controller 155. Each compartment refrigeration controller 155 can be utilized to set, adjust, and maintain a desired temperature within the given compartment 140. Similar to the refrigeration control 150, the compartment refrigeration controller 155 is a manual controller 156 in some embodiments, and a digital controller 157 in other embodiments.

Figure 1C:
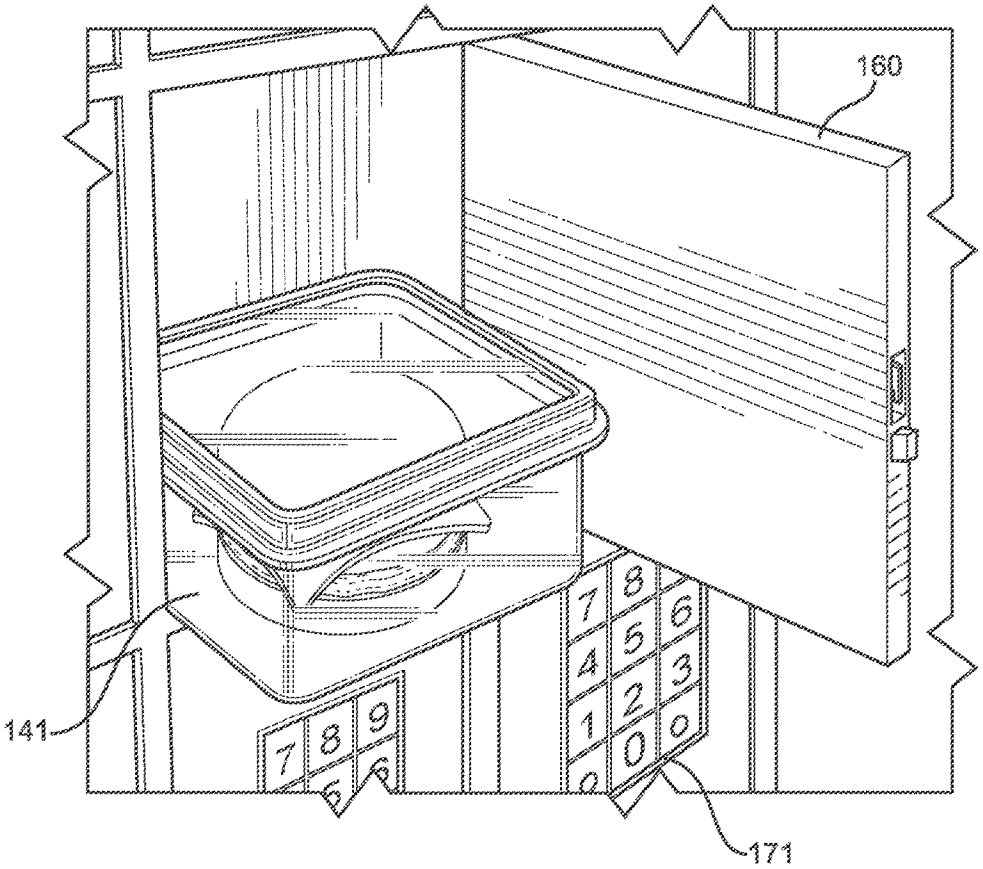
FIG. 1C shows a front perspective view of an embodiment of the compartmented refrigeration system, with a focus on an access door of a compartment in an open position granting access to the interior volume of the compartment.
Figure 1B:
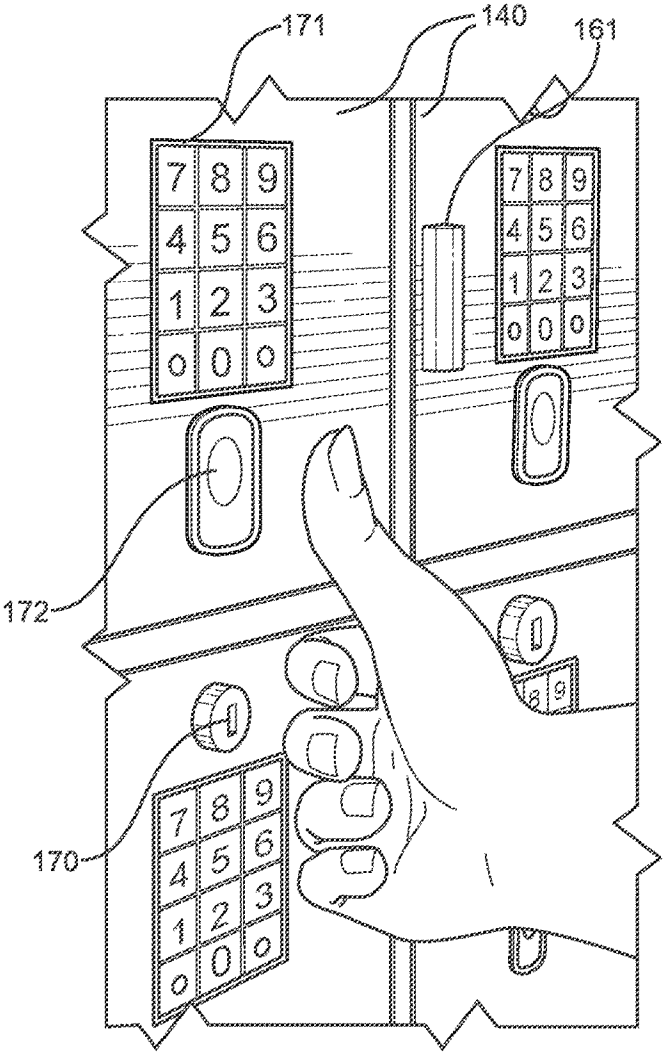
FIG. 1B shows a front perspective view of an embodiment of the compartmented refrigeration system, with a focus on a front surface of access doors of a plurality of compartments.

Referring now to FIGS. 1B and 1C, there are shown a front perspective view of an embodiment of the compartmented refrigeration system, with a focus on a front surface of access doors of a plurality of compartments, and a front perspective view of an embodiment of the compartmented refrigeration system, with a focus on an access door of a compartment in an open position granting access to the interior volume of the compartment. Each of the compartments 140 further comprise a compartment access door 160. Each compartment access door 160 is hingedly connected to its respective compartment 140 such that the compartment access door 160 can rotate between an open and closed configuration. When the compartment access door 160 is closed, a compartment interior volume is defined. The compartment interior volume can be used to store a desired item, such as food 141. Similar to the housing access door, in various embodiments, the compartment access door 160 further comprises a compartment handle 161. Each compartment access door 160 further comprises a lock 170 that can be utilized to secure the compartment access door 160 to the compartment 140. In this manner, unauthorized entry into the compartment 140 can be prevented. Such security in the compartment 140 is highly desirable as it enables a user to lock and secure personal effects, food, drink, medications and the like, thereby preventing unauthorized tampering or theft.

In the shown embodiment, each of the compartment access doors 160 further comprises a keypad 171 in operable connection with the lock 170. The keypad 171 can be utilized to input an access code that unlocks the lock 170 thereby enabling the compartment access door 160 to be opened and provide access to the compartment 140. Further, in the shown embodiment, each of the compartment access doors 160 further comprises a fingerprint scanner 172 in operable connection with the lock 170. The fingerprint scanner 172 can be utilized to receive a fingerprint of a person attempting to gain access to the compartment 140. The fingerprint of the person attempting to gain access can be compared to an authorized user's fingerprint. When a match is detected, the lock 170 can unlock enabling the user to gain access to the compartment interior volume. Where a match is not detected, the lock 170 remains locked. The fingerprint scanner 172 can be used independent of, or in combination with, the keypad 171 to unlock the lock 170 thereby enabling the compartment access door 160 to be opened and provide access to the compartment 140.

Referring now to FIG. 2, there is shown a schematic of an embodiment of the compartmented refrigeration system, with a focus on representative components thereof. The refrigeration system 200 comprises a compressor 210, a plurality of condenser coils 220, at least one expansion valve 230, a plurality of evaporator coils 240, and a refrigerant 250. The refrigerant 250 is contained within the system and can transition between a liquid, a vapor, and a gaseous phase.

The refrigeration cycle can be envisioned by starting with gaseous refrigerant 250 at a low pressure and low temperature in the compressor 210. The compressor 210 constricts the gaseous refrigerant 250, thereby increasing the refrigerant's 250 pressure and temperature. The compressor 210 pushes the refrigerant 250 into the condenser coils 220. When the condenser coils 220 containing the compressed and heated gaseous refrigerant 250, is exposed to air outside the device with a lower temperature, the heat from the refrigerant 250 is transferred to the air. This results in the refrigerant 250 cooling down and the refrigerant 250 condensing into a liquid. The liquid refrigerant 250 then passes through an expansion valve 230 where its pressure is quickly lowered resulting in some of the liquid refrigerant 250 expanding and turning into a vapor. This change in state from liquid to vapor has a cooling effect. As the cold vaporized refrigerant 250 travels through the evaporator coils 240, heat is removed from the air inside the interior volume. The refrigerant 250 then turns into a low temperature gas with a low pressure. This low temperature, low pressure gaseous refrigerant 250 is then introduced to the compressor 210 thereby starting the cycle anew.

In the shown embodiment, the compartmented refrigeration system utilizes a refrigeration system 200 solely in the housing 110. As described above, the interior volume of the housing 110 can be accessed by a housing access door 120. In one embodiment, the refrigeration system 200 is contained within the housing 110, except for the condenser coils 220. In a further embodiment, the expansion valves are also outside of the housing 110. Such a configuration enables air outside the device to contact the condenser coils 220 thereby enabling a heat transfer to air outside in the device. In some embodiments, fans can be utilized to pull outside air into contact with the condenser coils 220, thereby enabling the condenser coils 220 to be located within the housing 110. A housing controller 130 is in communication with the refrigeration system 200 and can control the flow of refrigerant 250 through the system. As detailed above, the housing controller 130 can be either digital or manual. In one embodiment, the housing controller 130 controls the amount of refrigerant 250 released through the expansion valve 230. In the shown embodiment, the plurality of compartments 150 are in thermal communication with the refrigeration system 200 and are cooled by the refrigeration cycle detailed above. Each of the compartments 150 include a compartment access door 160 and lock 170 in order to isolate and secure individual compartments within the interior volume of the housing 110.

Figure 3:
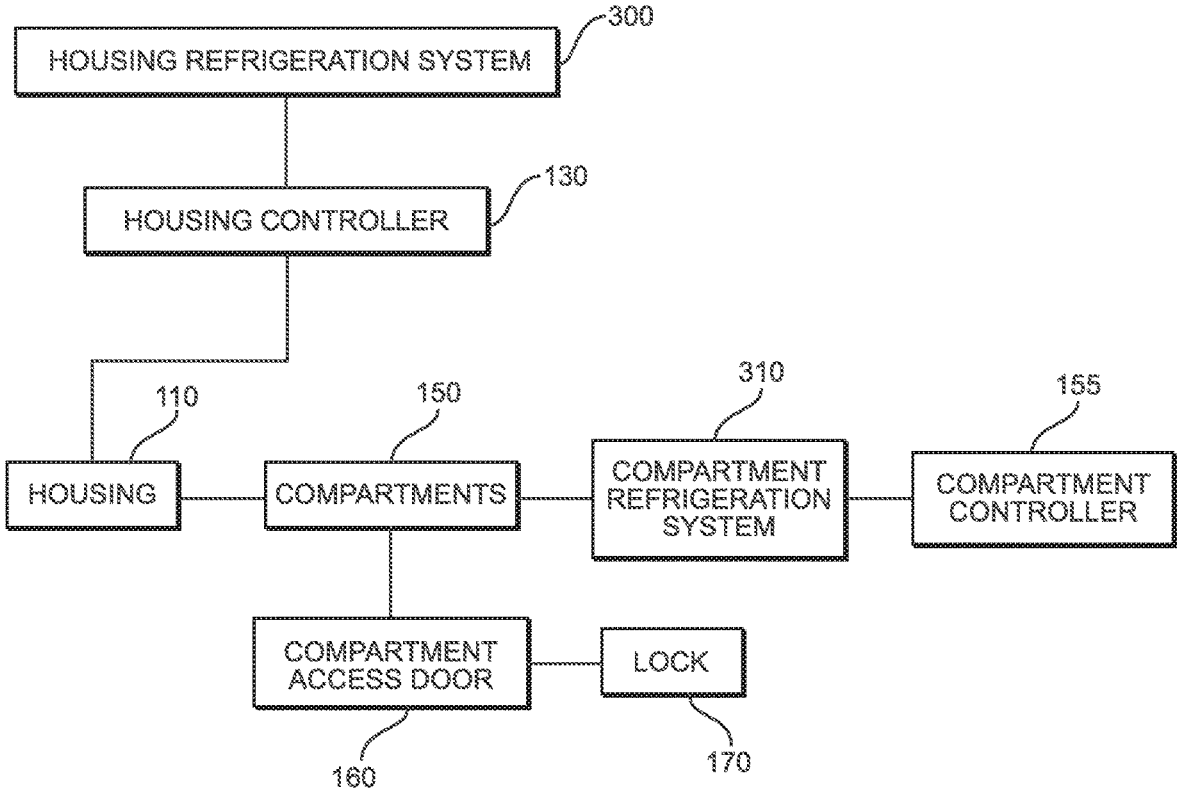
FIG. 3 shows a schematic of an alternate embodiment of the compartmented refrigeration system.

Referring now to FIG. 3, there is shown a schematic of an alternate embodiment of the compartmented refrigeration system. In the shown embodiment, the compartmented refrigeration system utilizes a housing refrigeration system 300 as well as separate and distinct compartment refrigeration systems 310 for each of the plurality of compartments 150. In one embodiment, the plurality of compartment refrigeration systems 310 are in thermal communication with each other. In one embodiment, the plurality of compartment refrigeration systems 310 are in thermal communication with each other as well as the housing refrigeration system 300. In an alternate embodiment, each of the compartment refrigeration systems 310 and the housing refrigeration system 300 are unique and distinct and are not in thermal communication with each other.

The housing refrigeration system 300 is controlled by a housing controller 130 as further described in the disclosure concerning FIG. 2, above. The housing controller 130 is disposed within the housing 110, enabling a user to set, adjust, and maintain a housing temperature. The housing 110 contains the plurality of compartments 150, wherein each of the plurality of compartments 150 have a respective compartment access door 160 and lock 170 thereon to prevent unauthorized access. Each compartment 150 contains its own compartment refrigeration system 310 which can cool that distinct compartment 150 to a desired temperature. Each compartment 150 also includes a compartment controller 155 which can be used to set, adjust, and maintain a desired temperature within the distinct compartment 150. As detailed above, both the housing controller 130 and each of the compartment controllers 155 can be digital, manual, or a combination thereof.

Figure 4:
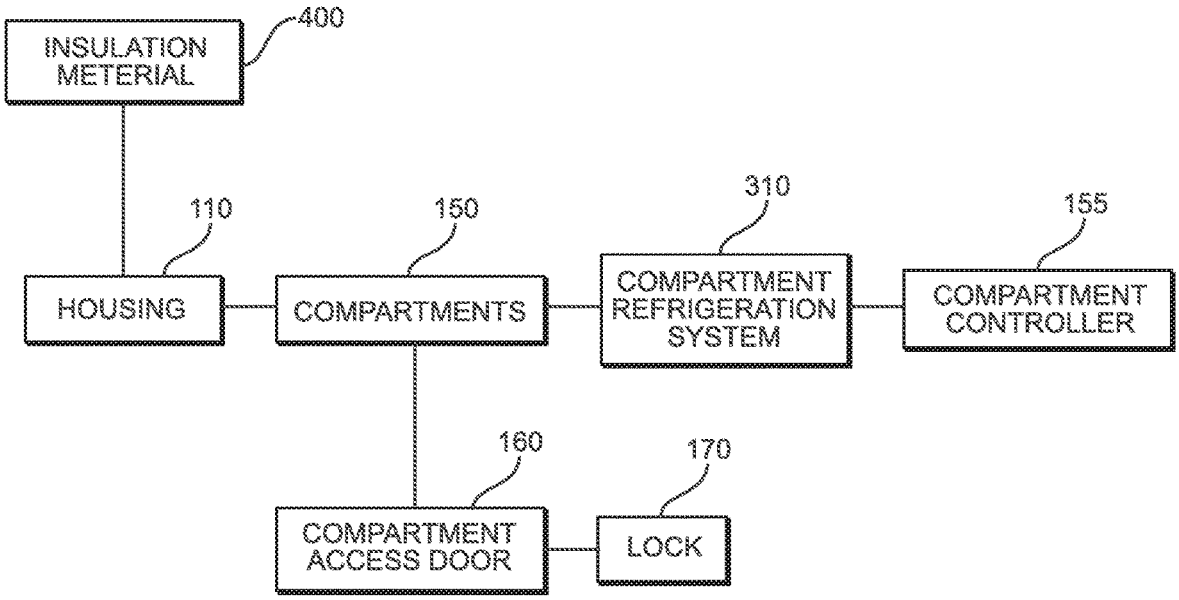
FIG. 4 shows a schematic of an alternate embodiment of the compartmented refrigeration system.

Referring now to FIG. 4, there is shown a schematic of an alternate embodiment of the compartmented refrigeration system. In the shown embodiment, the compartmented refrigeration system utilizes a refrigeration system solely in each of the plurality of compartments 150 and not in the housing 110. In such an embodiment, the housing 110 comprises an insulation material 400 that is configured to provide a thermal barrier between the interior volume of the housing 110 and the air exterior to the device. In this manner, a temperature differential can be established between the air exterior to the device and air in the interior volume. In the shown embodiment, each of the plurality of compartments 150 have a respective compartment access door 160 and lock 170 thereon to prevent unauthorized access. Each compartment 150 contains its own compartment refrigeration system 310 which can cool that distinct compartment 150 to a desired temperature. Each compartment 150 also includes a compartment controller 155 which can be used to set, adjust, and maintain a desired temperature within the distinct compartment 150. As detailed above, each of the compartment controllers 155 can be digital, manual, or a combination thereof. In one embodiment, each of the condenser coils from each of the compartment refrigeration systems 310 are in thermal communication with each other, inside the housing 110 interior volume. In such an embodiment, a housing ventilation system can provide outside air to transfer heat from the refrigeration cycle into the outside air. In an alternate embodiment, each of the condenser coils from each of the compartment refrigeration systems 310 are disposed outside of the housing 110 to enable heat transfer with air outside the device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A compartmented refrigeration system, comprising:
a housing with an access door defining a housing interior volume;
the access door hingedly attached to a sidewall along a longitudinal length enabling the access door to move between an open and a closed configuration;
the housing further comprising a refrigeration system;
wherein the refrigeration system comprises a compressor, a plurality of condenser coils, at least one expansion valve, a plurality of evaporator coils, and a refrigerant;
wherein the refrigeration system is configured to utilize the refrigerant to transfer heat from the interior volume of the housing to a space external to the compartmented refrigeration system;
a refrigeration controller disposed on a front face of the housing interior volume;
wherein the refrigeration controller comprises a dial;
wherein the refrigeration controller is placed on the housing at a contact location of the access door;
a plurality of compartments defined within the housing interior volume;
each compartment of the plurality of compartments rigidly affixed to the housing;
each compartment of the plurality of compartments defining a closed volume;
wherein each of the plurality of compartments further comprises a compartment access door;
each compartment access door comprising a compartment handle disposed on a side of an external face of each compartment access door;
the plurality of compartments in thermal communication with the refrigeration system;
each compartment access door further comprising a lock;
each compartment access door comprising a keypad in operable connection with the lock;
each compartment access door comprising a fingerprint scanner in operable connection with the lock;
wherein the fingerprint scanner is placed on the front face of each compartment access door below the keypad of each compartment access door;
the refrigeration controller accessible on a surface disposed outside of the plurality of compartments;
a handle disposed on the access door;
wherein the access door is transparent;
wherein the access door comprises a door insulation material that contacts the access door when the access door is in a closed configuration and creates a thermal seal such that heat is not lost through the joint between the access door and the housing.

2. The compartmented refrigeration system of claim 1, wherein each compartment door handle is disposed on a side of each compartment access door corresponding to a side of the access door on which the handle of the access door is disposed.

3. The compartmented refrigeration system of claim 1, wherein the housing comprises a rectangular cross-section.

4. The compartmented refrigeration system of claim 1, wherein the housing is free-standing and provides support and structure for the stand-alone compartmented refrigeration system.

5. The compartmented refrigeration system of claim 1, wherein each compartment access door opens in the same direction as the access door.

6. A compartmented refrigeration system, consisting of:
a housing with an access door defining a housing interior volume;
the access door hingedly attached to a sidewall along a longitudinal length enabling the access door to move between an open and a closed configuration;
the housing further comprising a refrigeration system;
wherein the refrigeration system comprises a compressor, a plurality of condenser coils, at least one expansion valve, a plurality of evaporator coils, and a refrigerant;
wherein the refrigeration system is configured to utilize the refrigerant to transfer heat from the interior volume of the housing to a space external to the compartmented refrigeration system;
a refrigeration controller disposed on a front face of the housing interior volume;
wherein the refrigeration controller comprises a dial;
wherein the refrigeration controller is placed on the housing at a contact location of the access door;
a plurality of compartments defined within the housing interior volume;
each compartment of the plurality of compartments rigidly affixed to the housing;
each compartment of the plurality of compartments defining a closed volume;
wherein each of the plurality of compartments further comprises a compartment access door;
each compartment access door comprising a compartment handle disposed on a side of an external face of each compartment access door;
the plurality of compartments in thermal communication with the refrigeration system;
each compartment access door further comprising a lock;
each compartment access door comprising a keypad in operable connection with the lock;
each compartment access door comprising a fingerprint scanner in operable connection with the lock;
wherein the fingerprint scanner is placed on the front face of each compartment access door below the keypad of each compartment access door;
the refrigeration controller accessible on a surface disposed outside of the plurality of compartments;
a handle disposed on the access door;
wherein the access door is transparent;
wherein the access door comprises a door insulation material that contacts the access door when the access door is in a closed configuration and creates a thermal seal such that heat is not lost through the joint between the access door and the housing.

* * * * *